United States Patent [19]

Pasierb, Jr. et al.

[11] Patent Number: 4,674,741

[45] Date of Patent: Jun. 23, 1987

[54] ROWING MACHINE WITH VIDEO DISPLAY

[75] Inventors: John J. Pasierb, Jr., Bartlett, Ill.; Augustine Nieto, Newport Beach; Bryan Andrus, El Toro, both of Calif.; George Kolomayets, Chicago, Ill.; Gary Oglesby, Lombard, Ill.; Allen Ryan, Chicago, Ill.

[73] Assignee: Bally Manufacturing Corporation, Chicago, Ill.

[21] Appl. No.: 762,709

[22] Filed: Aug. 5, 1985

[51] Int. Cl.[4] ..... A63B 21/00

[52] U.S. Cl. ..... 272/72; 272/128; 272/132

[58] Field of Search ..... 272/72, 132, 128

[56] References Cited

U.S. PATENT DOCUMENTS

| | | | |
|---|---|---|---|
| 2,604,198 | 7/1952 | Stephenson | 192/21.5 |
| 2,685,947 | 8/1954 | Votrian | 192/21.5 |
| 3,643,943 | 2/1972 | Erwin, Jr. et al. | 272/69 |
| 3,712,613 | 1/1973 | Feather et al. | 272/58 |
| 3,848,467 | 11/1974 | Flavell | 73/379 |
| 3,869,121 | 3/1975 | Flavell | 272/79 |
| 3,874,659 | 4/1975 | Aharoni | 272/129 |
| 3,929,335 | 12/1975 | Malick | 272/57 |
| 3,984,666 | 10/1976 | Barron | 235/151.3 |
| 3,989,240 | 11/1976 | Victor et al. | 272/125 |
| 3,991,749 | 11/1976 | Zent | 128/25 |
| 4,084,810 | 4/1978 | Forsman | 272/73 |
| 4,112,928 | 9/1978 | Putsch | 128/2.05 |
| 4,184,678 | 1/1980 | Flavell et al. | 272/129 |
| 4,235,437 | 11/1980 | Ruis et al. | 272/134 |
| 4,239,092 | 12/1980 | Janson | 188/267 |
| 4,261,562 | 4/1981 | Flavell | 272/129 |
| 4,278,095 | 7/1981 | Lapeyre | 128/689 |
| 4,323,237 | 4/1982 | Jungerwirth | 272/131 |
| 4,337,050 | 6/1982 | Engalitcheff, Jr. . | |
| 4,354,676 | 10/1982 | Ariel | 272/129 |
| 4,358,105 | 11/1982 | Sweeney, Jr. | 272/73 |
| 4,375,674 | 3/1983 | Thornton | 364/559 |
| 4,396,188 | 8/1983 | Dreissigacker et al. | 272/72 |
| 4,408,613 | 10/1983 | Relyea | 128/670 |
| 4,452,448 | 6/1984 | Ausherman | 272/131 |
| 4,463,945 | 8/1984 | Spector | 272/73 |
| 4,469,325 | 9/1984 | Ware | 272/72 |
| 4,477,071 | 10/1984 | Brown et al. | 272/72 |
| 4,479,646 | 10/1984 | Chirapozu | 272/73 |
| 4,488,719 | 12/1984 | Brown et al. | 272/72 |
| 4,489,938 | 12/1984 | Darzinskis | 272/142 |
| 4,493,485 | 1/1985 | Jones | 272/126 |
| 4,512,566 | 4/1985 | Bicocchi | 272/72 |
| 4,518,163 | 5/1985 | Bruder | 272/132 |
| 4,537,396 | 8/1985 | Hooper | 272/72 |

*Primary Examiner*—Leo P. Picard

*Attorney, Agent, or Firm*—Jenner & Block

[57] ABSTRACT

An improved rowing exercising machine is disclosed. The machine has a mechanical apparatus for accepting user stroke movements; each stroke has a power portion and a return portion. The mechanical apparatus converts the energy from the user stroke movements into rotation of a flywheel. In order to closely simulate the feel of momentum in actual rowing activity, electronic circuitry is used to control a brake to apply a force to slow the motion of the flywheel. The amount of force supplied by the brake is independent of the speed at which the user is rowing the machine and is under software control. The brake force can be varied to additionally slow down the rotation of the flywheel during the return portion of a stroke. The rowing machine includes a video display which gives the user the sense of competitive scull racing. The display shows an animated rowing figure having stroke movement synchronized with the user stroke movements. A pacer rowing figure is also displayed. During the rowing exercise, the distance separating the rowing figures depends on the user stroke movements and on pre-set pacer motion.

34 Claims, 17 Drawing Figures

FIG. 1
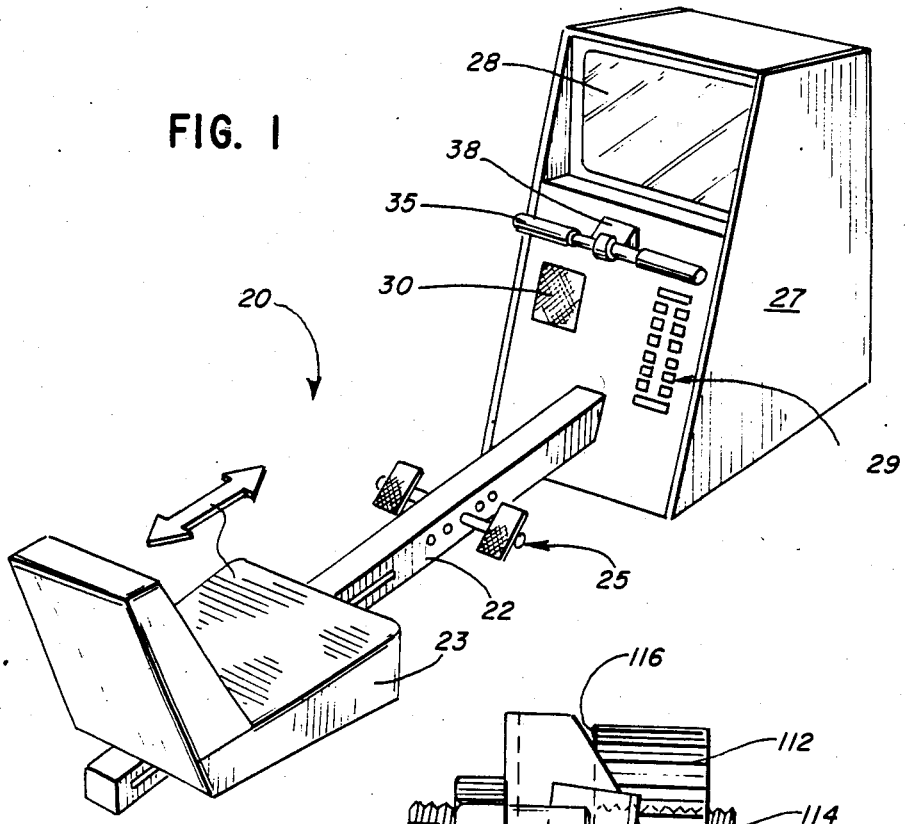
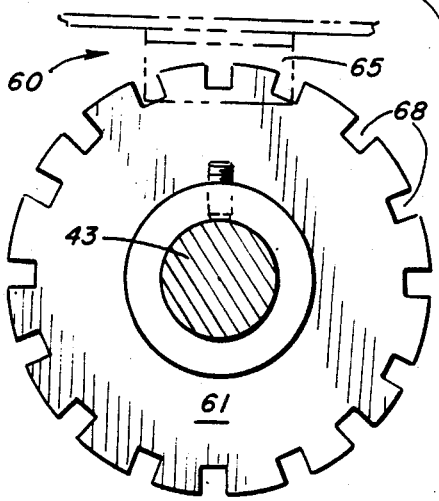
FIG. 4
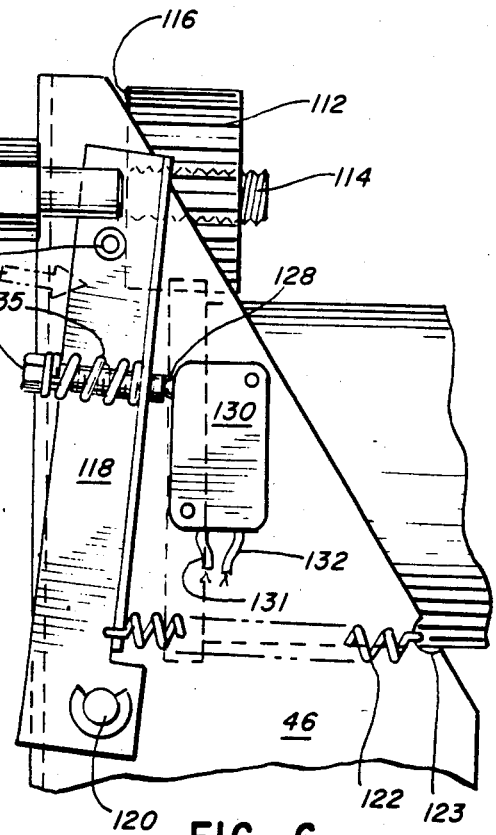
FIG. 6

ROWING MACHINE WITH VIDEO DISPLAY

TECHNICAL FIELD

This invention relates generally to exercise equipment, and more particularly concerns a rowing machine which will provide an exercise regimen very much like the exercise regimen obtained from actually rowing a boat or scull.

BACKGROUND OF THE INVENTION

The sport of the rowing has long been recognized as an excellent form of exercise. One who engages in the sport of rowing can thoroughly exercise and develop his legs, back, shoulders, arms, and other areas of his body. But no jarring, pounding effect is imparted to the exercising individual's knees or other body parts, as may occur in running or in other sports.

Rowing machines have long been offered to provide the benefits of this rowing exercise to greater numbers of people, and in indoor locations. But many of these rowing machines provide the user with the benefits of rowing exercise to only a limited extent. Some rowing machines do not provide the user with body movement and effort which truly duplicate rowing activity. And some machines cannot be adjusted to properly accommodate the various strengths and sizes of different machine users.

Recently, rowing machines have been offered which incorporate digital electronic circuitry. These machines permit the exerciser to select any one of a range of levels of exercise difficulty, and they provide a limited amount of information to the machine user. Such rowing machines are now offered by the Universal Gym Equipment Company, P.O. Box 1270, Cedar Rapids, Iowa 52406 and by the AMF Volt Company, 3801 South Harbor Boulevard, Santa Ana, Calif. 92704.

Some known rowing machines have a drive system which includes a flywheel for preserving, in the form of angular momentum, energy put into the machine by the user. A resistance to the angular motion of the flywheel is provided to simulate, to a limited extent, the actual feel of rowing motion. The resistance in these machines is provided by an alternator or generator which is coupled to an electrical load resistor. As the rotational velocity of the alternator or generator increases, so does the resistance felt by the rowing machine user. In other words, the resistance provided by these machines is dependent on the speed at which the user is rowing. Such machines do not simulate the true feel of actual rowing motion.

Furthermore, some rowing machines do not provide a mechanism for controlling the rotational velocity of the flywheel. Thus, the feel of momentum sensed by the machine user cannot be adjusted on a controlled basis. Controlling the speed of the flywheel is desirable so that the beginning of a stroke will not be too easy for the user. It is also desirable that the user be able to select the amount of momentum he wishes to feel independently of the speed at which he chooses to row.

In addition, some rowing machines do not provide for the true sense of competitive scull racing. While some prior machines provide a rough indication of the user boat position in relation to a pacer boat, an accurate and visually interesting graphic display has not been provided.

It is accordingly the general object of the present invention to provide an exercise machine which can closely duplicate the activity, the resistive forces and the consequent feel of actual rowing or sculling activity.

Another general object is to provide a rowing machine in which the user can control the machine in order to modify the feel of momentum sensed in actual rowing so that the machine will have the proper feel to the user. A related object is to provide for such user control independently of rowing speed.

Still another object is to provide an exercise machine of the type described which provides an accurate and visually interesting graphic illustration of the progress and success of the exercising individual during the exercise program.

Other objects and advantages of the invention will become apparent upon reading the following detailed description and upon reference to the drawings. Throughout the drawings, like reference numerals refer to like parts.

DISCLOSURE OF THE INVENTION

An improved rowing exercise machine is disclosed and claimed. Broadly speaking, the machine comprises a user interface means adapted to accept rowing stroke-like movement by the machine user. Converting means converts energy imparted to the user interface means into rotation of a flywheel. A brake applies a force to oppose this rotational flywheel movement; the brake force is independent of the rotational velocity of the flywheel and is controlled by a microprocessor.

In the specific embodiment illustrated here, the user interface means includes a cable which is drawn from a cable drum when the machine user executes the power portion of a stroke. The converting means includes a cable drum carried on a shaft and a flywheel for receiving and conserving angular momentum is connected to this same shaft. A magnetic particle brake unit is also connected to the shaft to provide the opposition or braking force. A one-way clutch is interposed between the cable drum and the shaft to permit continued flywheel rotation even while the cable drum is being reversely driven to wind up the cable.

A stroke detector detects the user's stroke movements, and provides an electrical signal which is coupled to the processor. A video display, connected to the processor, generates an animated rowing figure and other information of interest and concern to the exercise machine user.

BRIEF DESCRIPTION OF THE DRAWINGS

FIG. 1 is a perspective view showing a novel exercise machine embodying the present invention;

FIG. 4 is a sectional view taken substantially in the plane of line 4—4 in FIG. 2;

FIG. 6 is a fragmentary elevational view of an end-of-stroke indicator mechanism included in the units shown in FIG. 2;

DESCRIPTION OF THE PREFERRED EMBODIMENT

Figure 2:
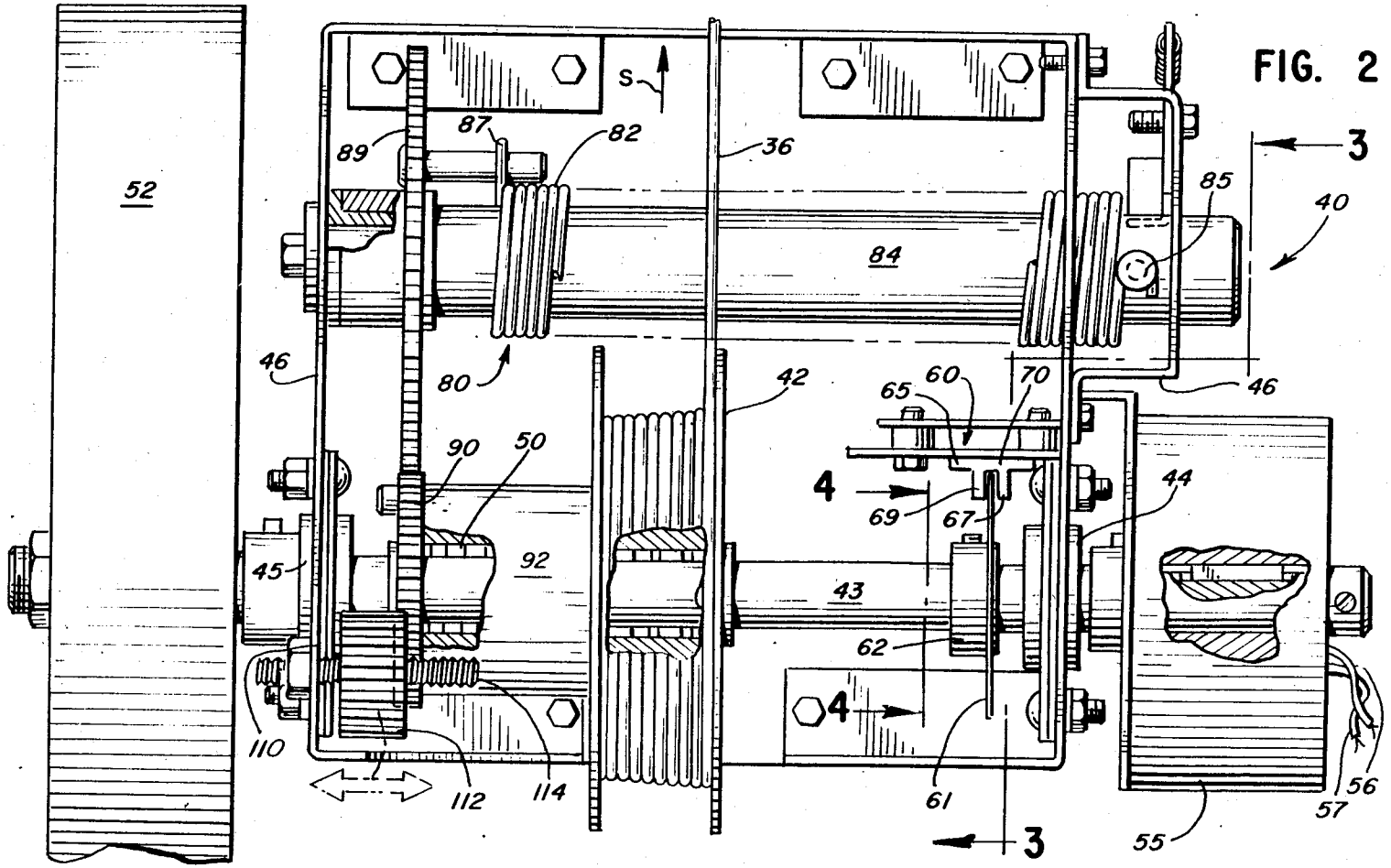
FIG. 2 is a top plan view of a mechanical unit included within the machine.
Figure 3:
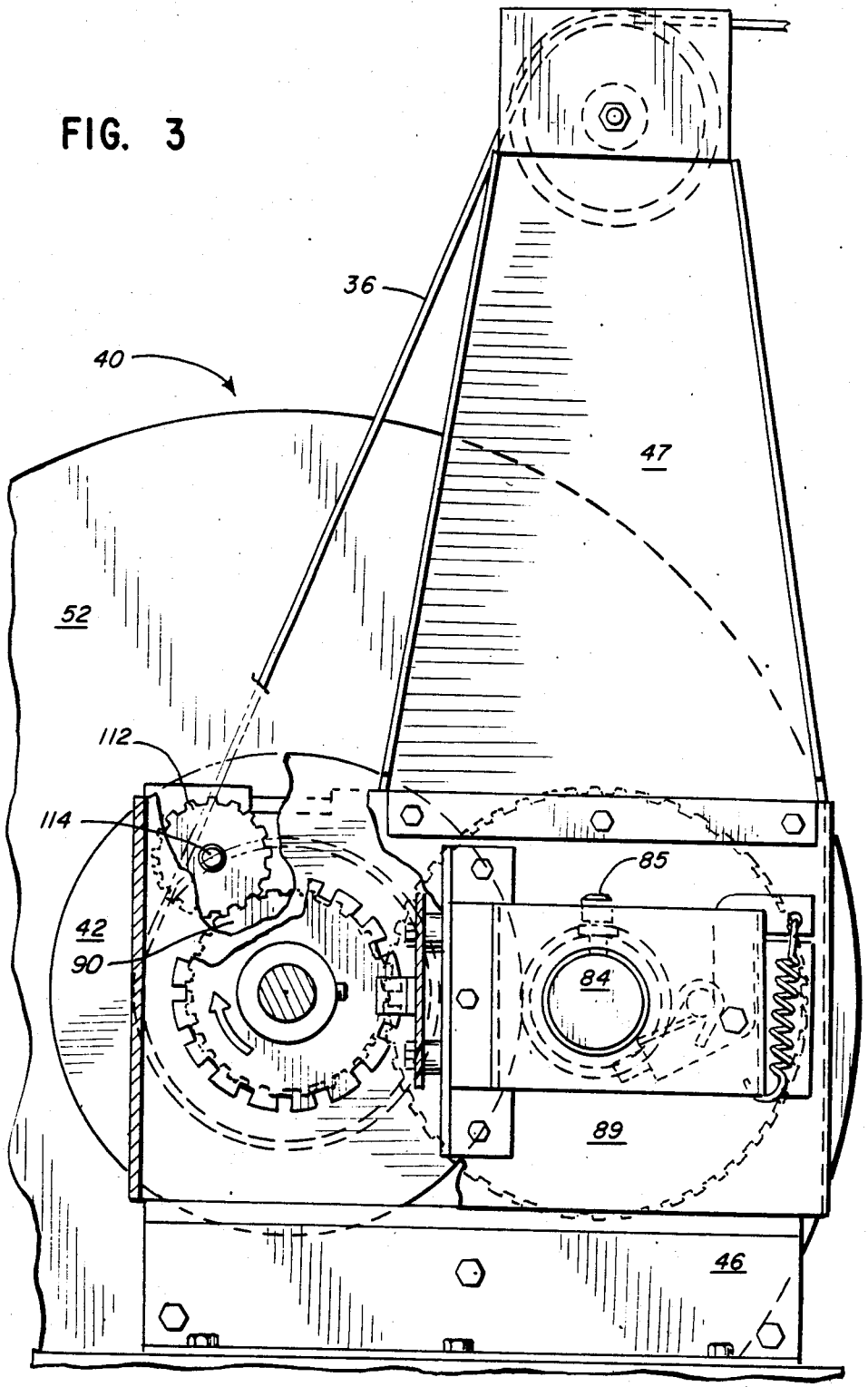
FIG. 3 is a sectional view taken substantially in the plane of lines 3—3 of FIG. 2.

Turning first to FIG. 1, there is shown an exercise machine 20 embodying the present invention. In general, this exercise machine includes an elongated rail 22, upon which is mounted a seat 23. A roller assembly (not shown) permits the seat to move back and forth in reciprocal manner along the rail 22. If desired, a foot arrangement can be provided at one end of the rail so as to support the rail 22 in a generally level position slightly above the floor on which the exercise machine 20 is generally placed.

An opposite end of the rail 22 is supported within the lower portions of a cabinet or housing structure 27. The cabinet 27 houses a video monitor 28 in the top portion and a speaker 30 in the bottom portion. A machine user control panel is also provided on the cabinet 27; this panel takes the form of a keypad 29 having various keys bearing alphanumeric indicia.

An exercise handle 35 is connected to a flexible cable 36 (FIG. 2). This cable 36 can be pulled from and drawn at least partially back into the cabinet 27 through a cable port 38. In use, an exercising individual sits upon the seat 23 and braces his feet on a foot rest assembly 25. He then grasps the handle 35 with both hands, and pulls the handle 35 and cable 36 toward himself. While doing so, he extends his legs, thereby moving the seat 23 along the rail in a direction away from the cabinet 27. This motion will be referred to as the power portion of a stroke.

At the end of the power portion of a stroke, the user releases pressure on the cable, and mechanism within the cabinet 27 retracts the cable 36, thereby drawing the handle 35 back toward the cabinet 27. This will be referred to as the return portion of a stroke. Because the exercising individual maintains his grip upon the handle 35 during the return portion of the stroke, his legs are drawn into a flexed position, his arms are extended, and the seat 23 is drawn along the rail 22 toward the cabinet 27. When the cable 36 has been retracted at least partly into cabinet 27, the exercising individual may begin another exercise cycle.

Figure 5:
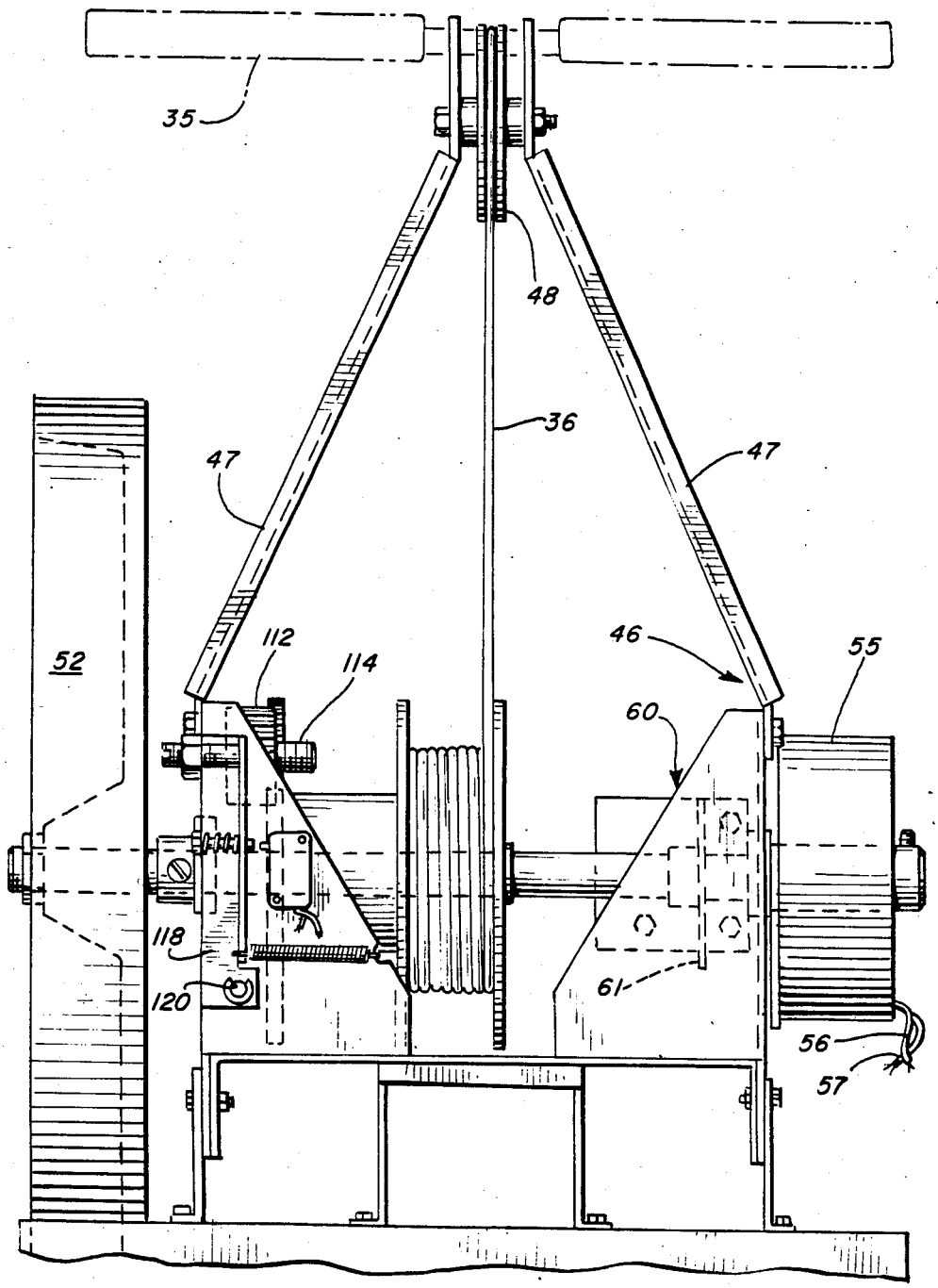
FIG. 5 is a front elevational view of the unit shown in FIG. 2.

A unit 40 for converting the motion of the cable 36 and handle 35 into flywheel rotation is shown in further detail in FIGS. 2–6 inclusive. As shown especially in FIG. 2, the cable 36 is wound about a cable drum 42 carried by a master shaft 43. This shaft 43 is journaled by bearings 44 and 45 to a frame 46; the frame 46 can be secured within the cabinet 27 by mounting bolts or other convenient devices. As shown in FIG. 5, the frame can include a superstructure 47 mounting a pulley 48 over which the cable 36 is routed for connection to the handle 35.

When the cable 36 is drawn off the drum 42 during the power position of a stroke (as indicated by the arrow S in FIG. 2), the drum 42 and shaft 43 rotate together. When, however, the cable 36 is rewound on the drum 42 in the return direction, the drum 42 and shaft 43 do not rotate together; this independence of motion is provided through a one-way clutch mechanism 50 which can be a sprag-type clutch or other design.

When an oarsman begins to row his scull from a standing start, his first few strokes require much effort and produce little boat movement. But once his scull has begun to move forward, the oarsman's subsequent strokes are not like those he first experienced, because his scull has developed some forward momentum. To provide the feel of momentum in this rowing machine, a flywheel 52 is affixed to the master shaft 43. As the cable 36 is drawn out during the power portion of a stroke and the drum 42 and shaft 43 are rotated, the affixed flywheel 52 begins to rotate. This flywheel 52 acts as a reservoir of angular momentum in a well-known manner.

When an oarsman stops rowing, his boat or scull naturally slows down, because its motion is retarded by the action of the water. To simulate this retardation, a brake unit 55 is connected to the opposite end of the master shaft 43. In accordance with one aspect of the invention, the braking effect is controllable, and the effect is independent of the angular or rotative speed of the shaft 43, so as to most closely duplicate the action of water against a boat. To these ends, the brake unit 55 used in the preferred embodiment is a magnetic particle brake which applies a constant torque braking effect independently of rotational velocity. Extending from the brake 55 are wires 56, 57. The amount of force applied by the brake 55 to the shaft 43 is directly porportional to the current flowing through the wires 56, 57. The current applied to these wires is controlled and altered by the electronic circuitry described below. One commercially available magnetic power brake is the Model B-5 brake offered by Magnetic Power Systems, Inc. of Fenton, Mo.

The angular velocity of the shaft 43 is sensed or detected by an optical detecting device 60 as shown in FIGS. 2 and 4. The detecting device 60 takes the form of a notched wheel 61 affixed to the shaft 43 by a collar 62. An optical sensing unit 65 is mounted to a portion of the frame 46 at a convenient location to surround the periphery of the wheel 61. A light emitter 67 continuously emits light; as the light passes through the notches 68 in the wheel 61, that light is sensed by a light sensor 69. The sensor 69 emits an electrical signal; the signal is transmitted to other parts of the circuit through a wire 70.

In carrying out the invention, the cable 36 is automatically rewound on the drum 42 during the return portion of a stroke. To this end, a cable rewind mechanism 80 is also mounted on the frame 46. Here, this rewind device 80 takes the form of a coil spring 82 which fits over a stationary shaft-like mount 84. One end of the coil spring 82 is affixed, as by a bolt 85, to the shaft 84. The other end 87 of the coil spring 82 is attached by a mounting pin 88 or other convenient device to a rotatable rewind gear 89.

The rewind gear 89 meshes with a smaller drive gear 90 which is mounted on an extension 92 of the cable drum 42. Thus, as the cable 36 is drawn away from the drum 42 in the direction S during the power portion of a stroke, the drum 42 rotates, and with it rotates the gear 90. This gear 90 rotation causes rotation of the rewind gear 89, and consequently a winding action is imparted to the spring 82. When the force on the cable 36 is released, the spring 82 unwinds itself, thereby driving the gears 89 and 90, and rewinding the cable 36 on the cable drum 42. While the cable rewinding action is occurring, the one-way clutch 50 is disengaged, and the master shaft 43 and flywheel 52 continue to spin in the direction imparted by the power stroking motion. Thus, when a subsequent power stroke is made, the exercising individual finds it easy to start a new stroke. But as the one-way clutch 50 engages, the exercising individual must accelerate the flywheel 52, and so completing the power stroke is more difficult than beginning the stroke. This assumes, of course, that the brake 55 has not been controlled to completely stop the rotation of the shaft 43. If the shaft has been stopped the user will be met with an equal amount of resistive force during each phase of a power stroke.

As explained below, it is important to electrically indicate that a power stroke has been initiated. To this end, a beginning-of-stroke detecting and signalling mechanism 110 is provided. Specifically, the mechanism 110 comprises a pinion gear 112 of relatively elongated axial extent, as shown particularly in FIGS. 2, 3, 5 and 6. This pinion gear 112 meshes with the rewind gear 90, and so rotation of the cable drum 42 rotates the meshed gear 112 in the well-known manner.

The pinion gear 112 is provided with a threaded interior hub to mate with threads formed on a mounting stubshaft 114. The stubshaft 114 can be a common machine bolt. Thus, as the gear 112 is rotated by the rewind gear 90, the pinion gear 112 moves axially, as shown in FIGS. 2 and 6.

An end 116 is engaged by a cam-following finger 117 which is mounted upon a lever 118, as especially shown in FIG. 6. This lever 118 is pivotally mounted on the frame 46 as by a mounting pin 120 of known design. The cam-following finger 117 is caused to closely follow the axial motion of the gear surface 116 as the gear 112 turns, because a spring or other biasing device 122 of known type is connected between a stationary portion 123 of frame 46 and the pivotable lever 118. Thus, as can be envisioned, when the gear 112 is helically rotated along the stubshaft 118 by the motion of the meshing gear 89, the lever 118 is caused to pivot as shown by the arrow P, FIG. 6.

Mounted to the pivotable lever 118 is an adjustable contact stop or pin 127. This pin 127 is disposed so as to contact the actuating finger 128 of a microswitch 130. Leads 131, 132 extend from the microswitch for connection to other parts of the electric circuit described below. If desired, this contact pin 127 can be resiliently mounted as by a spring arrangement 135, so as to avoid overstressing the switch contact finger 128. Thus, as the cable 36 is withdrawn from the drum 42, the gears 90 and 112 rotate and the lever 118 pivots. The lever pivot motion causes the pin 127 to operate the microswitch 130 and signal the beginning of a power stroke. The pin 127 is adjustable so that differing cable lengths can be pulled out before the switch 130 is actuated. In the preferred embodiment, the pin is set so that the switch is actuated when approximately two feet of cable have been pulled out.

In summary, the unit 40 provides two electrical signals: the angular velocity signal on line 70 and the beginning of stroke signal on lines 131 and 132 from the switch 130. The unit 40 and in particular, the brake unit 55, receives an electrical signal on lines 56 and 57. The signals to and from the unit 40 are coupled to the electronic control circuitry.

Figure 7:
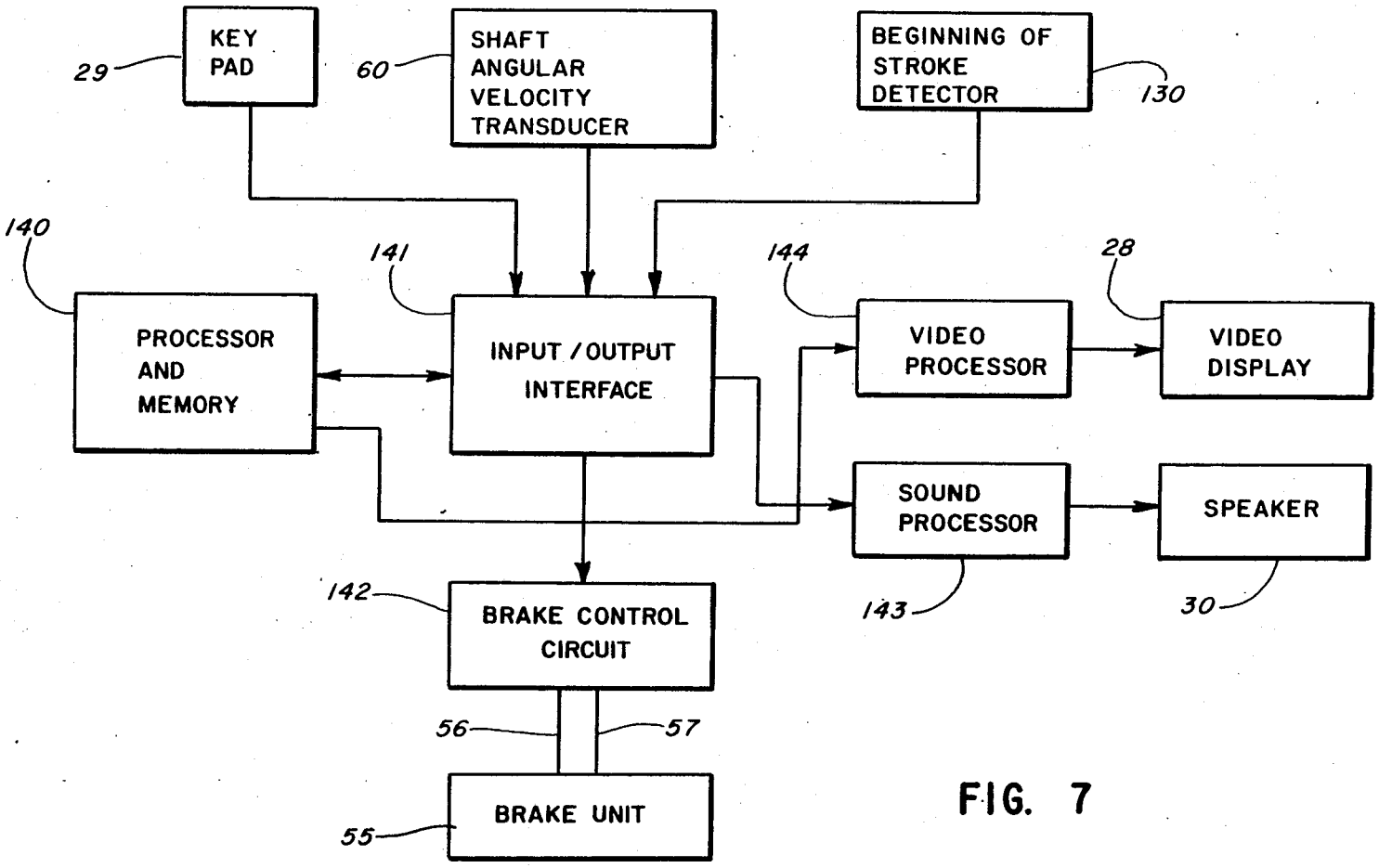
FIG. 7 is a block diagram of the electronic circuit of the present invention.

As shown in the block diagram of FIG. 7, signals from the angular velocity detector transducer 60, the beginning of stroke detector 130, and the key pad 29 are received by an input/output interface 141. The interface transfers the received signals to a processor and memory 140. The processor, under the control of a software program contained in the memory, operates on the received data to provide output signals to control the brake unit 55, the video display 28 and the speaker 30. The output signals for the video display 28 are further processed by a video processor 144 before being sent to the display. The control signal to the brake 55 is converted to an analog signal and amplified before it is sent to the brake. Likewise, a sound processor 143 converts the speaker data from the microprocessor to an analog signal for transmission to the speaker 30.

The processor and memory block 140, the input/output interface 141, the video processor 144, the sound processor 143 and the brake control circuit 142 perform three main functions; namely, (1) receiving and processing the information entered by the user via the keypad 29, (2) monitoring the angular velocity of the shaft 43 and controlling its velocity through the brake 55, and (3) providing the appropriate video and audio signals to the video monitor 28 and the speaker 30. Each of the electronic control circuit blocks shown in FIG. 7 are shown in more detail in FIGS. 8–12.

Figure 8:
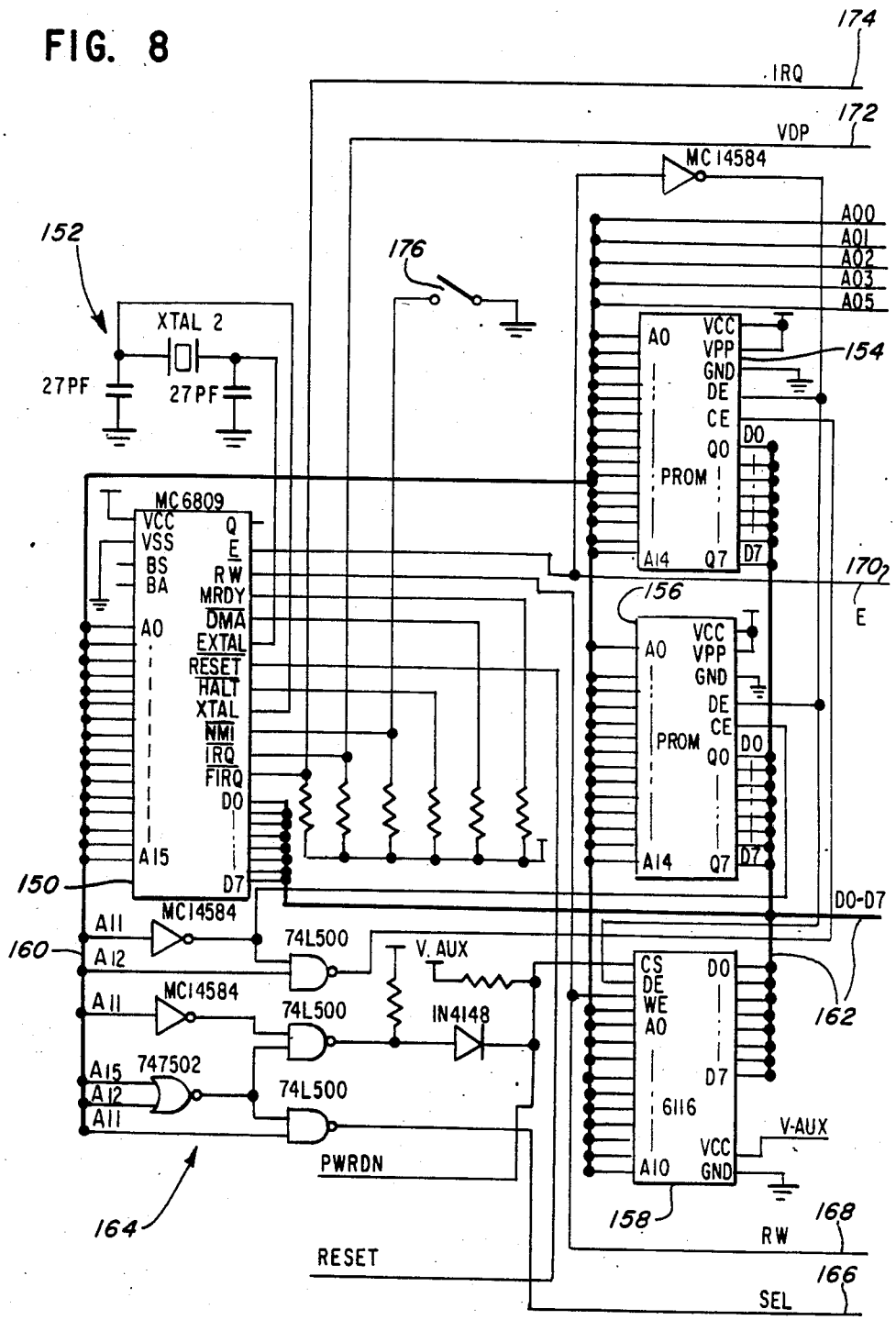
FIG. 8 is a schematic diagram of the microprocessor and memory shown in block form in FIG. 7.

FIG. 8 illustrates the microprocessor and memory block 140. The microprocessor 150 in the preferred embodiment is a Motorola 6809 microprocessor. A crystal oscillator circuit 152 provides a clock input to the microprocessor 152. The software program for the microprocessor is stored in read only memories (ROMs) 154 and 156. The ROMs 154 and 156 also store information utilized by the video and sound processors 144 and 143. For example, the shape and color information for various graphics displayed on the monitor are stored in the ROMs 154 and 156. Other memory storage means for the microprocessor is provided by a random access memory (RAM) 158. The microprocessor communicates with the memory chips by an address buss 160 and a data buss 162. The data buss 162 as well as certain lines of the address buss 160 is also used to communicate with other ciruity as will be described below.

Address decode circuitry 164 is used to select and enable the memories chips 154,156 and 158 when the address buss 160 contains the appropriate address. In addition, the address decode circuitry provides the select (SEL) signal 166 to enable the input/output interface circuitry 141 and the video processor 144. The microprocessor provides a read/write (RW) signal 168 to control the direction of data transfer on the data buss 162. The microprocessor provides a timing enable (E) signal 170 to indicate its machine state. Interrupt Request (IRQ) and Video Display Process (VDP) signals 172 and 174 interrupt the microprocessor 150 when the input/output interface circuitry 141 or the video processor 144 wishes to transfer data to or receive data from the microprocessor 150 on data buss 162.

Figure 9:
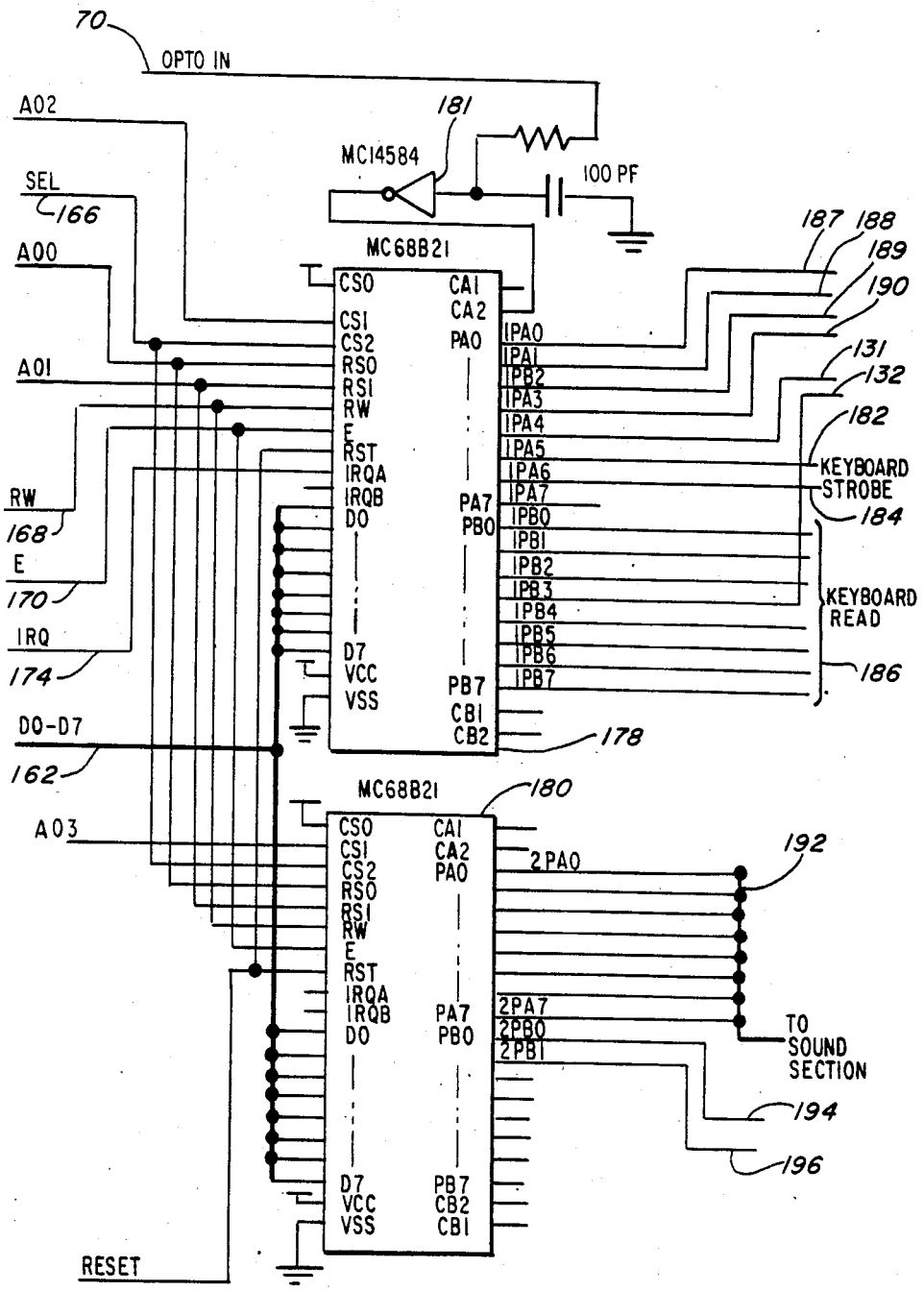
FIG. 9 is a schematic diagram of the Input/Output interface shown in block form in FIG. 7.

In FIG. 9, the input/output interface 141 is illustrated. The input/output interface consists solely of two peripheral interface adaptors (PIA) 178 and 180. The PIAs are used to interface the data buss 162 with peripheral devices as illustrated in FIG. 7. PIA 179 receives data from the machine key pad 29. Lines 182 and 184 are used as strobe lines, and the seven lines represented by reference numeral 186 are used to sense or read the keypad 29 to determine whether a particular key is actuated. The keypad can be arranged in a 2×7 matrix, providing for fourteen different keys, i.e., "Start," "Enter," "Yes," "No" and the numerals "0–9," on the keypad 29.

Lines 131 and 132 are connected to the beginning-of-stroke detector switch 130 to determine whether the switch is actuated. Line 132 is a strobe line and line 132 is a read line.

Lines 187 and 190 are outputs from PIA 178. These lines provide signals which are used by the brake control circuit 142 (see FIG. 12) to control the amount of force provided by the brake 55. Line 70 is the input from the optical sensing unit 65 and in particular from the light sensor 69. This signal passes through a schmidt trigger inverter 181 to PIA 178. PIA 180 provides an output to the sound processor 143 (see FIG. 11) on a data buss 192.

The microprocessor 150 controls the flow of data to and from the PIA's 178 and 180 on data buss 162 by the read/write control line 168, the enable timing signal 170, and the select signal 166 (FIGS. 8 and 9). The address lines A00 to A03 are used to select the desired register (A or B) within PIA's 178 and 180. PIA 178 uses interrupt request line (IRQ) 174 to notify the microprocessor 150 that data has been received from a peripheral device and is available for transfer to the microprocessor.

Figure 10:
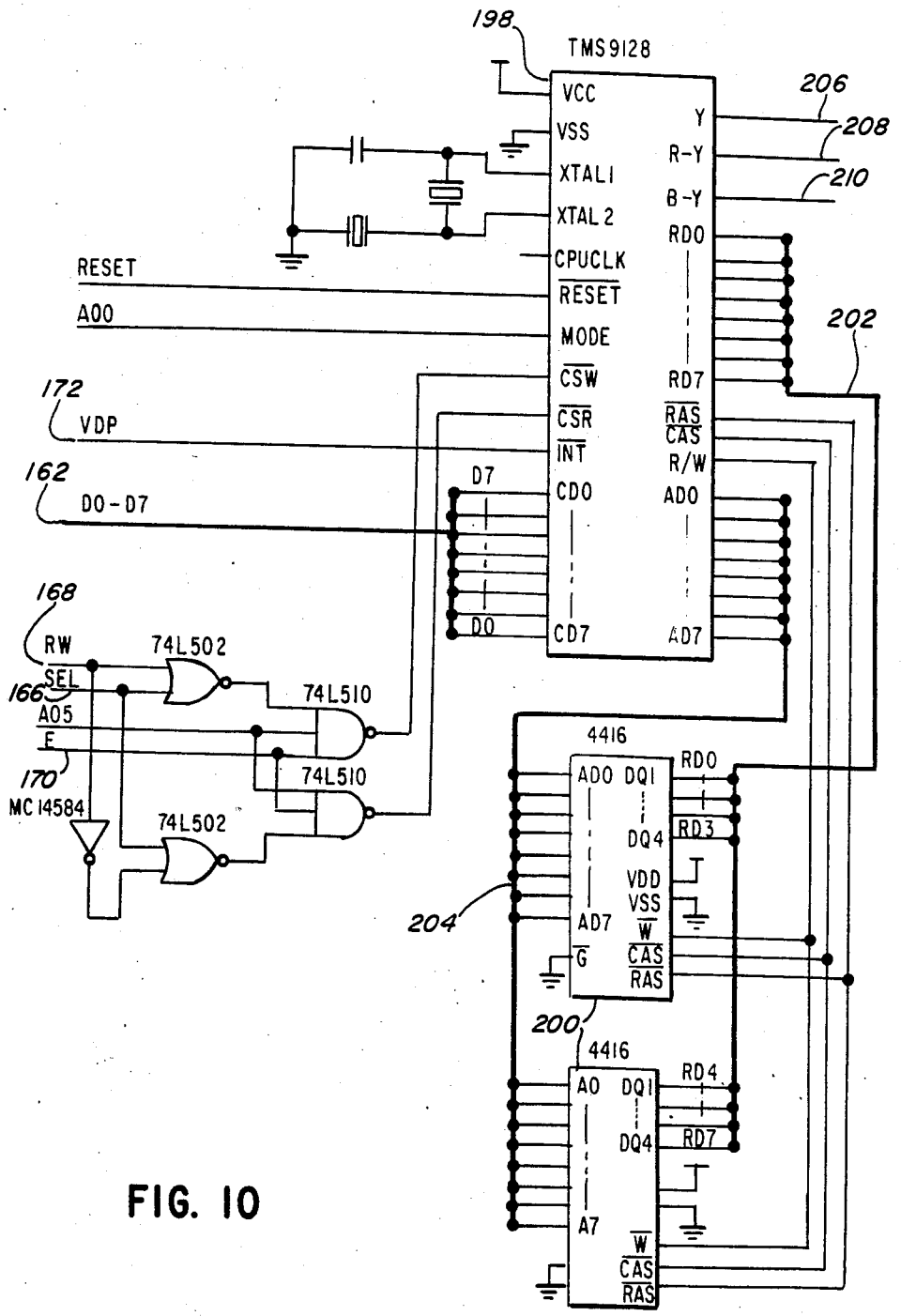
FIG. 10 is a schematic diagram of the video processor shown in block form in FIG. 7.

FIG. 10 illustrates the video processor circuitry 144. This circuitry 144 transforms the data on data buss 162 to a form which can be used by the video monitor 28. In the preferred embodiment, this circuitry comprises a Texas Instruments video display processor 198 and associated video RAM 200. The video processor interrupts the microprocessor by providing a signal on VDP line 172. The microprocessor controls the flow of data on the data buss 162 by the read/write line 168, the select line 166, the timing enable line 170 and the address lines A00 and A05. A data buss 202 is used to transfer data between the video display processor 198 and the video RAM 200. The video display processor 198 address the video RAM 200 by an address buss 204. The luminance and composite sync signal (Y), the red color difference signal (R-Y) and the blue color difference signal (B-Y) is provided by the video display processor on lines 206,208 and 210 respectively. These signals are decoded into red, blue, green and sync signals (by conventional circuitry not shown) to drive the video monitor 28.

Figure 11:
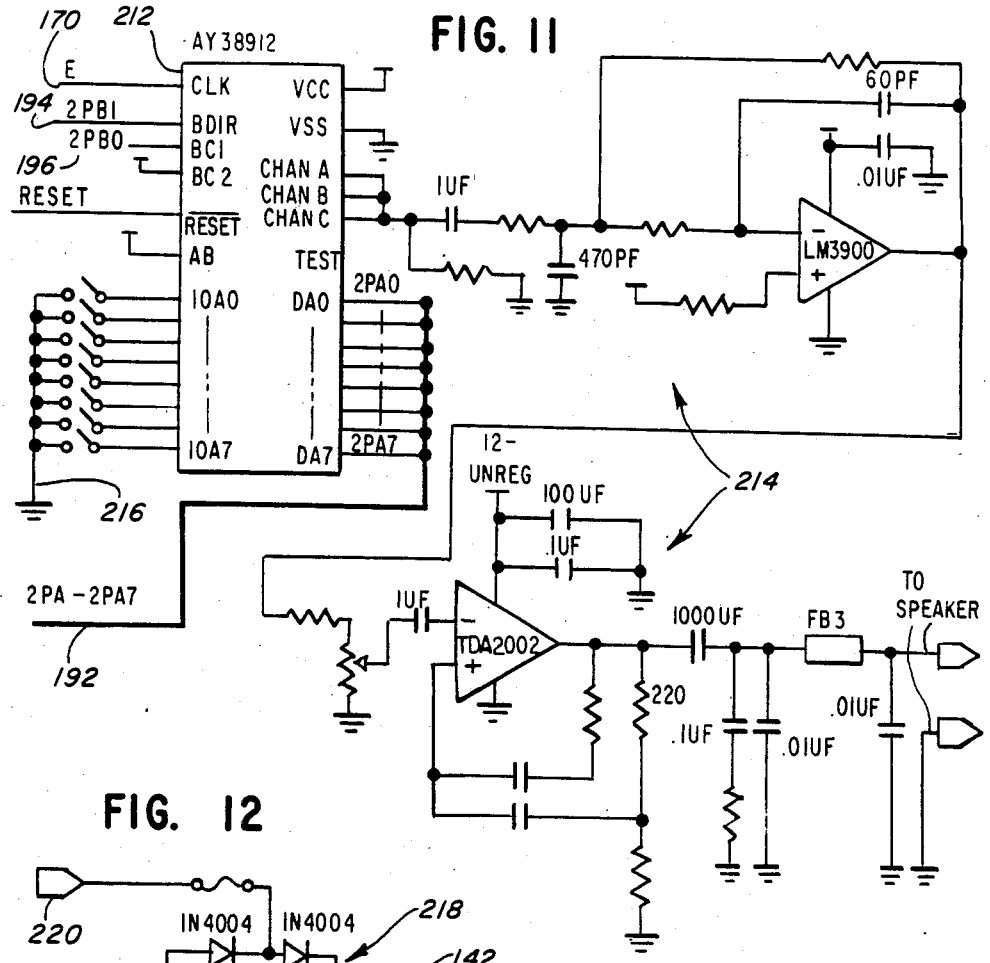
FIG. 11 is a schematic diagram of the sound processor shown in block form in FIG. 7.

FIG. 11 shows the sound processor 143 circuitry which decodes the data received from PIA 180 on data buss 192 into an audio signal used to drive the speaker 30. A General Instruments sound chip 212 is used to decode the data on the data buss 192. Analog circuitry 214 amplifies and filters the signal from the sound chip 212 before it is supplied to the speaker 30. The sound chip 212 is also used to transfer the state of a switch 216 to the PIA 180 for relay to the microprocessor 150. The switch 216 controls, for example, the maximum rowing time of the machine. Lines 194 and 196 are used to control the flow of data between PIA 180 and the sound chip 212.

Figure 12:
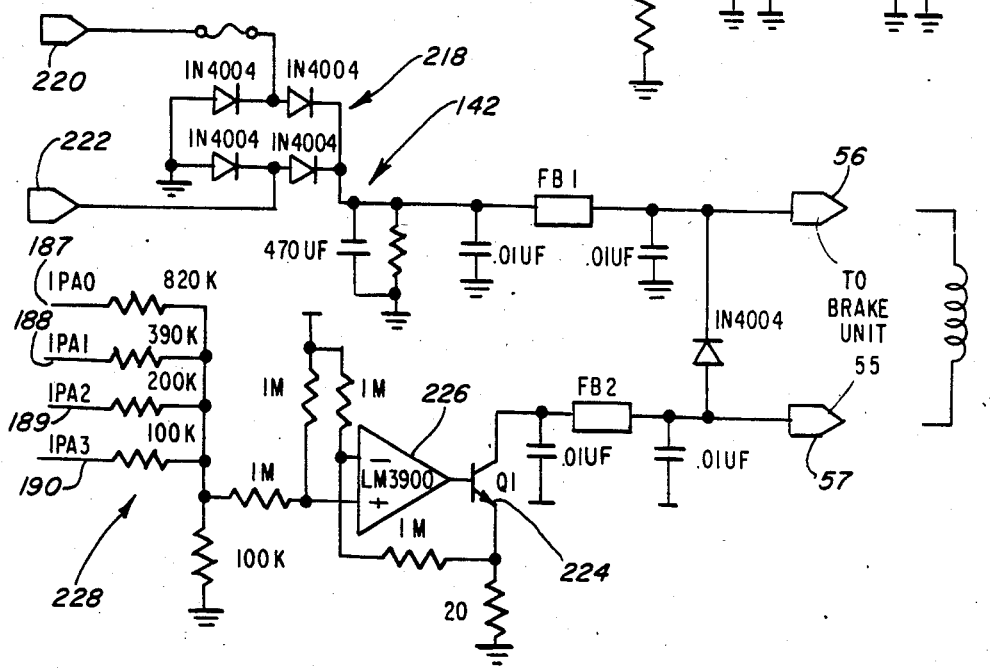
FIG. 12 is a schematic diagram of the brake control circuitry shown in block form in FIG. 7.

FIG. 12 illustrates the brake control circuitry 142. As can be seen, a rectifier circuit 218 rectifies an AC voltage (supplied on two lines 220 and 222) to a DC voltage. The AC voltage supplied on lines 220 and 222 is such that the DC voltage present between lines 56 and 57 is equal to the voltage needed to make the brake 55 operate properly. For the magnetic brake previously mentioned, this voltage is approximately 90 VDC.

In order to control the amount of force applied by the brake, the current to the brake is controlled by a transistor 224. The base of the transistor is coupled to the output of an operational amplifier 226, the non-inverting input of which is connected to a resistor divider network 228. Since the brake is connected between leads 56 and 57 and thus acts as an inductor to the circuit shown in FIG. 12, the divider network 228 in combination with the operational amplifier 226 and the transistor 224 acts as a current source for the brake which is controlled by the binary number input on the lines 187–190.

Thus, the amount of force applied by the brake is controlled by lines 187 to 190 from PIA 178 which is in turn under control of the software program. For the component values shown in the circuit of FIG. 12, the current supplied to brakes 55 varies approximately 10 mA per step. That is, if lines 187 to 190 are all logic "0's," there is no current supplied to the brake and if lines 187–190 are all logic "1's," 150 mA is supplied to the brake.

As mentioned, the software program controls the amount of force applied by the brake. The amount of force applied by the brake is determined by processing the information received from the beginning of stroke detector 130, the optical sensor 69 and the keypad 29 as will be described in more detail below. The software program also controls the video and sound processors to provide various visual and audio information to the user.

Figure 13:
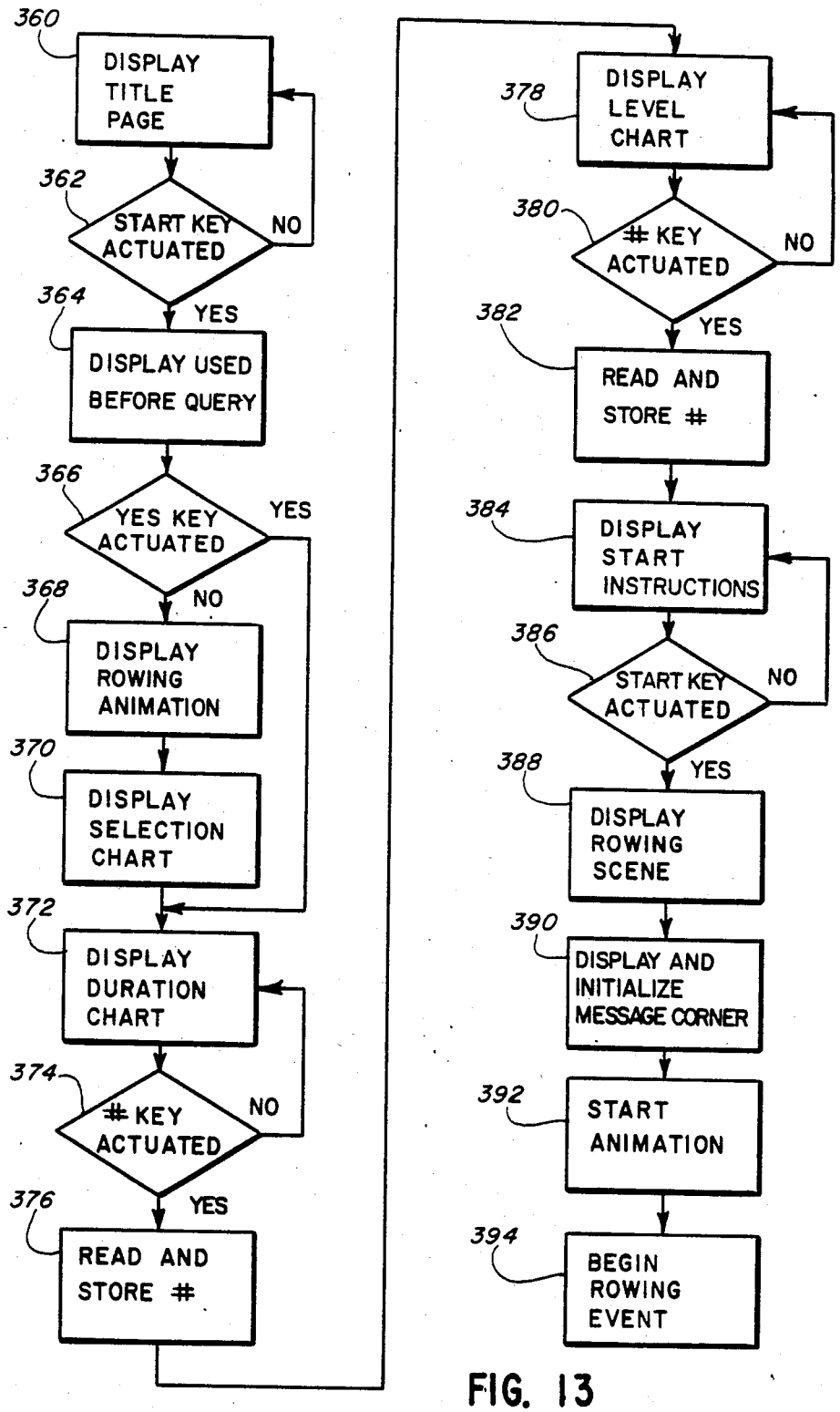
FIG. 13 is a flow chart of the portion of software which controls the video display before the rowing exercise is started.

FIG. 13 illustrates a flowchart for the portion of software which controls the video display 28 before the start of rowing exercise. The alpha-numeric characters, animation sequences and other graphic data displayed are implemented by using standard video display techniques. A block 360 displays a title page which displays the message, "Hit start to begin." A block 362 then monitors the start key to determine whether it is actuated. Once the start key is actuated, a message inquiring, "Have you used this machine before? Yes or No" is displayed by a block 364. A block 366 then monitors the yes key to determine whether it is actuated within a preset period of time.

If the yes key is actuated within the set period, the program jumps to a block 372 which is described below. If the no key is not actuated within the set period, a block 368 displays an animation sequence illustrating the proper way to row. The sequence begins with a rower in the start position. Other rowing positions—midstroke, end stroke and return stroke—are then displayed in rapid sequence, and are repeated three times to illustrate the proper way to row. Messages such as "Keep your back straight and upright throughout the exercise" and "Begin with legs and pull through with arms" are displayed along with the animation sequence.

A block 370 then displays a chart illustrating the various difficulty levels and race durations which can be selected by the user. The graph shows that a beginner rower would select a race duration from one to six minutes at a difficulty level from 1 to 4 with an expected stroke rate of 26 strokes per minute; an intermediate rower would select a race duration of twelve minutes at a difficulty level from 5 to 8 with an expected stroke rate of twenty-eight strokes per minute, and an advanced rower would select a race duration of twenty minutes at a difficulty level from 9 to 12 with an expected stroke rate of thirty strokes per minute.

After block 370 is displayed for a preset period of time or if in block 366 the yes key was not actuated within the set period, a block 372 displays a race duration chart asking, "What duration race do you want?" The chart also shows the various race durations and the corresponding rower levels (beginner, intermediate and advanced). A block 374 then monitors the key pad to determine if a number key(s) has been actuated. A block 376 reads and stores the number entered by the user.

A block 378 then displays a difficulty level chart inquiring, "What difficulty level race do you want?" The chart shows the various difficulty levels and the corresponding rower level. A block 380 monitors the keypad to determine if a key is actuated. A block 382 reads and stores the number entered by the user. A block 384 then displays the message "Press start to begin rowing." A block 386 monitors the start key to determine if it is actuated.

Figure 14:
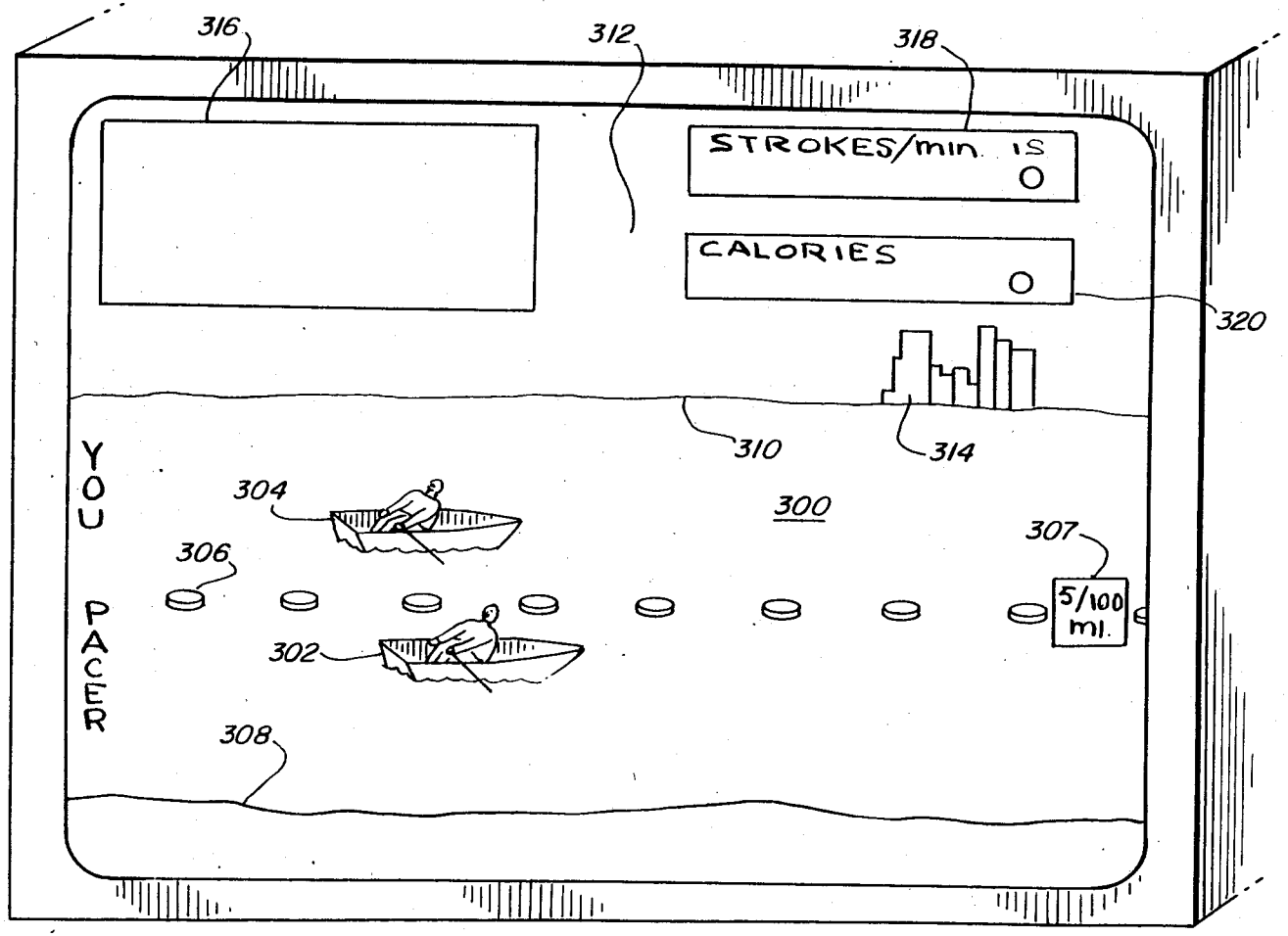
FIG. 14 is an illustration of the display seen by a user of the exercise machine.

Once block 386 determines that the start key has been actuated, a block 388 displays a competitive rowing scene as shown in FIG. 14. The scene shows a body of water 300 with two rowing figures 302 and 304 on it. Across from rowing figure 304 is displayed the word "YOU" and across from rowing figure 302 is displayed the word "PACER." A series of buoys 306 separate the rowing figures. Milage signs 307 are displayed between the buoys. The block 388 also displays a near shoreline 308, a far shoreline 310, a sky 312 and a city scape 314. Message blocks 316, 318 and 320, which will be described below, are also displayed by the block 388.

The sky 312, the body of water 300 and the words "YOU" and ∓PACER" are background displays which do not change throughout the rowing exercise. The data to display the two rowing figures 302 and 304 is stored in several separate memory blocks in the ROMs 154 or 156. Each of the separate blocks displays the rowing figures in one of several rowing positions which when displayed one after the other result in an animation so that the figures appear to be rowing. The video processor 144 displays the rowing figures as foreground sprites so that the position (here only the horizontal position) of each is variable and controllable by the software program. The city scape 314 and the milage signs 307 are also foreground sprites.

The buoys 306 are stored in twenty-four separate memory blocks in the ROMs 154 or 156. When displayed on the screen, each block is eight pixels high and twenty-four pixels long. Each of the twenty-four separate blocks stores the buoys in a slightly different location with respect to the start of the block. Thus, the blocks can be displayed one after the other so that the buoys appear to move on the screen. Seversal blocks are displayed end to end to substantially cover the length of the screen. The rate at which the buoys move across the screen, i.e. the scroll rate, is controlled by the software program as described below.

The shorelines 308 and 310 are each stored in memory blocks in the ROMs 154 or 156. When displayed on the screen, each block is eight pixels high and 256 pixels (i.e. the entire screen length) long. A pointer in the software controls which portion of the block appears on the left edge of the screen. Thus, as the pointer is incremented, the shorelines appear to move on the screen.

When the rowing figures 302 and 304 are animated, and the buoys, shorelines, milage signs and city scape are scrolled, the scene will appear to the viewer as though the figures are rowing down the body of water 300. Further, when the horizontal location of one of the rowing figures is changed with respect to the other figure, one of the figures will appear to be rowing faster than the other.

Returning to FIG. 13, after block 388 displays the rowing scene, a block 390 displays "Strokes/minute" and "Calories," in message blocks 318 and 320 respectively. The block 390 initializes the displayed values for both messages to zero. A block 392 then controls message display 316 to show an animation sequence with accompanying sounds to begin the rowing exercise. The animation sequence shows a starting gun; nautical bells and crowd cheers signal the user that the exercise is about to begin. The starting gun is raised as starting commands, "Mark, "Get Set," "Go" are displayed. Simultaneous with the "Go" command, the starting gun is seen and heard to go off. A block 394 then begins the rowing event by controlling the microprocessor to monitor the optical sensor and the beginning of stroke detector. The block 394 also controls the PACER rowing figure so that it appears to be rowing.

Once the rowing event has begun the user can advance his row boat on the display screen by "rowing" the rowing machine. As the power pulls out on the handle 35, the shaft 43 is rotated, as described above.

Figures 15, 16:
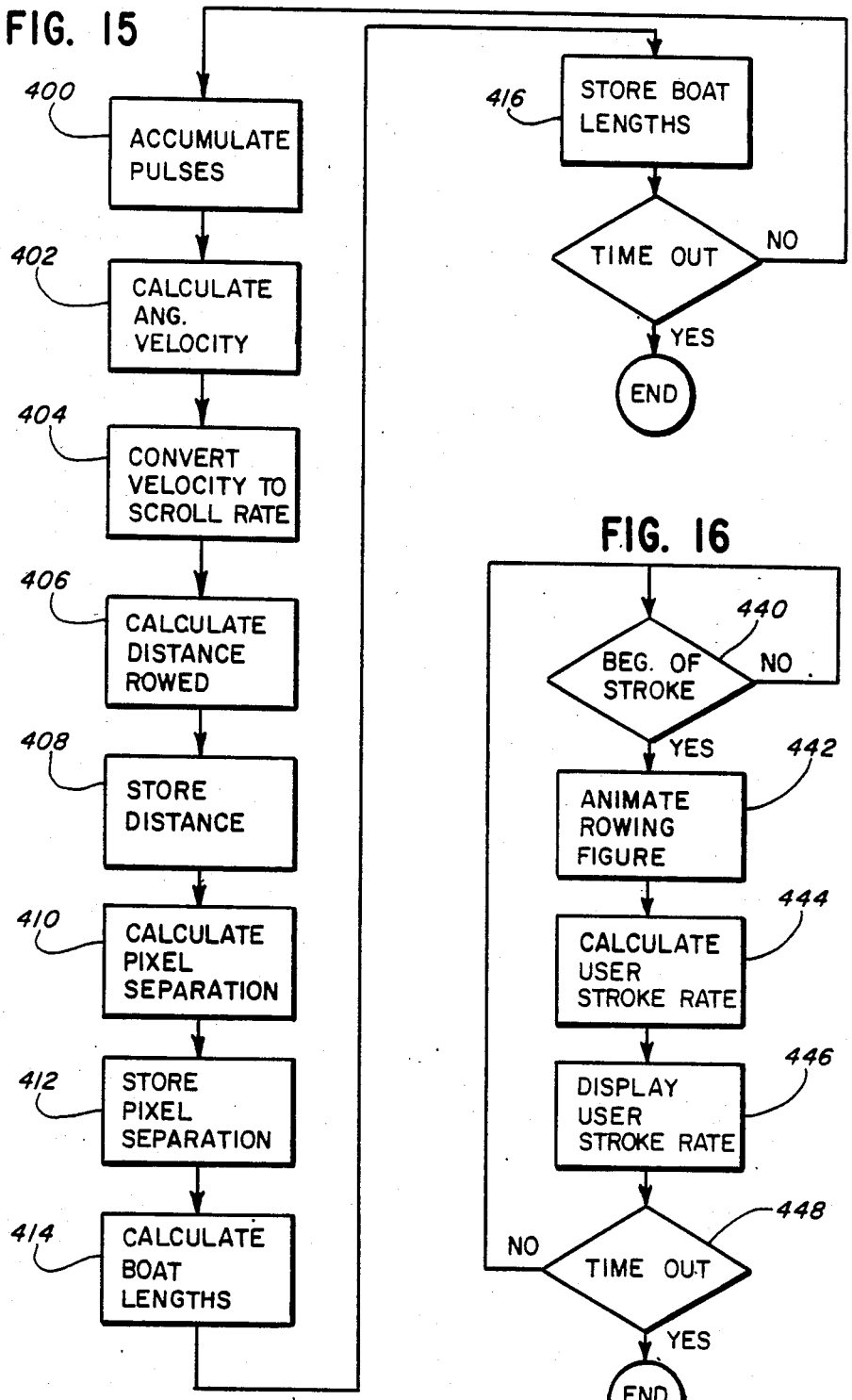
FIG. 15 is a flow chart of the portion of software which controls the display in FIG. 14.
FIG. 16 is a flow chart of the portion of software which further controls the display of FIG. 14.

As the shaft is rotated, the microprocessor receives pulses from the optical sensor 69. Referring to FIG. 15, a block 400 accumulates the number of pulses received over a fixed period of time. A block 402 then calculates the shaft angular velocity by dividing the number of pulses accumulated by the time over which they were accumulated. This number is in units of revolutions per unit time. Since every revolution of the shaft 43 represents forward movement of the user's boat, the angular velocity of the shaft corresponds to the speed of the user's boat. Distance on the display screen 28 is measured by the software program in terms of pixels. Therefore, the shaft angular velocity is easily converted into pixels per unit time, i.e., scroll rate.

A block 404 converts the shaft angular velocity into the scroll rates for the buoys, milage signs, shorelines and city scape. The scroll rate of the buoys, milage signs and near shoreline are chosen to be equal. The scroll rate of the far shoreline is equal to one-half the rate of the near shoreline in order to give the rowing scene in FIG. 13 a three-dimensional effect. To further enhance this effect, the scroll rate of the city scape, while still dependent on the shaft angular velocity, is much less the buoy's scroll rate.

To calculate the distance rowed by the user, a block 406 multiplies the average buoy scroll rate by the time which has elapsed since the start of the rowing exercise. The distance travelled is stored by a block 408 so that it can be displayed in message corner 316 and displayed on the milage signs 307. A block 410 calculates the distance, i.e., the number of pixels, which should separate the rowing figures 302 and 304 in view of the distance calculated in block 406. The distance travelled by the pacer is the pacer speed (a constant dependent on the difficulty level selected) times the time elapsed since the start of the race. The number of pixels which should separate rowing figures 302 and 304 is stored by a block 412 so that the video processor can update the distance separating the rowing figures.

A block 414 then calculates the number of boat lengths separating the user rowing figure and the pacer. In the preferred embodiment, one boat length equals sixteen pixels. Thus, the number calculated in block 410 can be divided by sixteen in block 414 to yield the boat lengths separating the rowing figures. This number is stored by a block 416 so that it can be displayed in message corner 316.

A block 418 checks to see if the race duration timer has reached zero. If time has not run out, a return is made to block 400 so that the scroll rate and distance calculations can be updated. If time has run out, the program ends.

The beginning of stroke detector provides a signal every time the user begins the power portion of a stroke. The stroke signal is used to synchronize the strokes taken by rowing figure 304 with the strokes taken by the user and to calculate the user stroke rate. As illustrated in FIG. 16, a block 440 monitors the beginning of stroke signal to determine if the rising edge of the signal has been detected. If the signal is detected, a block 442 displays the rowing animation sequence for rowing figure 304. Thus, every time the user takes a stroke on the rowing machine, the animated rowing figure also rows his boat. The animation of the pacer figure 302 is independent of user motion and is controlled by the software in relation to the difficulty level selected.

A block 444 accumulates the total time over the last 4 strokes detected since the beginning of the race and, divides this number by 4, and converts to calculate the user stroke rate. In essence, a running average of the stroke rate is kept over the last 4 strokes. This number is displayed in message corner 318 by a block 446, A block 448 checks to see if the race duration timer has reached zero. If the timer has not run out, a return is made to block 440; if time has run out, the program ends.

The flywheel acts to conserve the work (or energy) put into the machine by the rower. This energy conservation represents the coasting of the scull when a rower is returning his oars to begin the power portion of his next stroke. The brake acts to simulate the resistive forces of the water upon the boat. The magnitude of the force is controlled by the software in relation to the difficulty level selected by the rower. In accordance with one aspect of the invention, the brake applies a constant torque to oppose to the rotation of the shaft. The torque applied is independent of the velocity at which the shaft is rotating.

However, supplying a constant force to the shaft by the brake may not give the rowing machine user the proper feel. That is, since the clutch 50 will not engage until the rower causes it to turn at an angular velocity equal to the angular velocity of the master shaft 43, the resistance felt by the user during the beginning of subsequent strokes may not be great enough. In order to give the machine the proper feel in accordance with another aspect of the invention, the software program acts to slow down the master shaft 43 when the rower is not in the power portion of his stroke. To do so, the software controls the brake during the return portion of a stroke, to apply a force greater than the force normally felt by the user.

Figure 17:
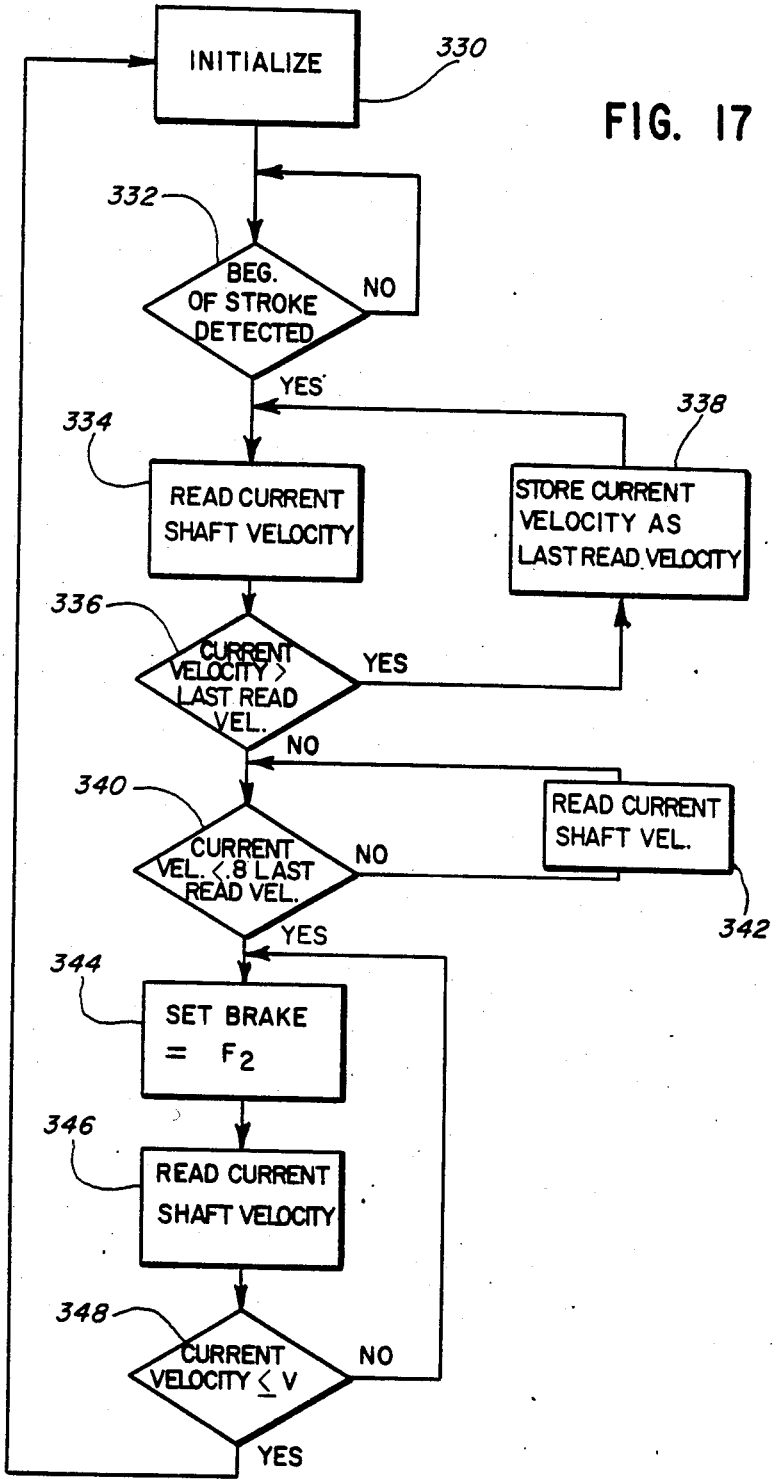
FIG. 17 is a flow chart of the portion of software which controls the brake.

The flowchart in FIG. 17 illustrates the control program according to which the microprocessor 150 operates to slow down the shaft 43 when the user is in the return portion of a stroke. In an initialization block 330, the last read velocity is set equal to zero and the difficulty level entered by the user via the keyboard 29 is read. The desired return stroke velocity is set equal to a predefined velocity and the brake force is set to a first force value. Both of these values are set in accordance with the particular difficulty level entered.

The beginning of stroke switch 110 is then monitored as shown in a block 332. The switch is continually monitored until a beginning of stroke is detected. Once the beginning of stroke is detected, the current velocity of the shaft 43 is read in a block 334. The current shaft velocity is then compared with the last read velocity in a block 336. If the current velocity is greater than the last read velocity, the current velocity is stored as the last read velocity in a block 338. The loop from block 334 to block 336 to block 338 to block 334 will be continually repeated as long as the shaft 43 is increasing in speed.

Once it is determined that the current velocity is not greater than the last read velocity, a comparison is made in a block 340 to determine if the current shaft velocity is less than, for example, 80% of the last read velocity. The last read velocity is now the greatest shaft velocity read since the beginning of stroke was detected in block 332. If the current velocity is not less than 80% of the peak shaft velocity, the shaft velocity is read again by a block 342. The block 340 to block 342 loop continues until the current shaft velocity is less than 80% of the peak shaft velocity.

After the current velocity falls below 80% of the peak velocity, it is assumed that the user has completed the power portion of the present stroke and a block 344 controls the brake to apply a second brake force which is preferably the maximum force the brake can apply. This will, of course, quickly slow down the shaft velocity. A block 346 then reads the current velocity and a block 348 determines whether the shaft has been slowed to the desired velocity as set in the initialization block 330. These steps are repeated until the brake is slowed to the desired velocity. After the shaft has been slowed to the desired velocity, a return is made to initialization block 330 at which time the first brake force will again be applied.

In the above example, the forces applied by the brake during the power portion of the stroke and the return portion of a stroke, while different from each other, were both constants. However, the program can control the brake to apply several different forces during both the power and return portions of a stroke. The forces so applied can be controlled in accordance with a predefined program stored in the memory. Furthermore, the forces applied by the brake can be made dependant on the speed at which the user is rowing the machine, in addition to being dependent on the difficulty level selected.

In order to provide the user with information about his or her exercising experience, the message block 316 shown in FIG. 13 is constantly and repeatedly updated with different messages. The desired user stroke rate and the distance travelled are displayed. The number of boat lengths the user is ahead or behind the PACER is also displayed. In between these messages, other messages such as "Keep your back straight" and "Use your legs" are also displayed so that the user will properly operate the rowing machine.

To provide the user with further information, a running count of the Calories expended by the user is displayed in message block 320. The number of calories, C, expended by the user is calculated by the software program according to the following formula:

$$C=1/E\times 1/B\times 1/4{,}184Ed+Kc$$

where

E=mechanical efficiency of the rowing machine (assumed to be 95%)

B=mechanical efficiency of a human body rowing (assumed to be 60%)

Kc=metabolic Calories consumption of human body (assumed to be 0.03 Cal/sec)

Ed=energy delivered to the rowing machined by the user.

The energy delivered to the rowing machine can be easily calculated since the mass and radius of the flywheel are known, the braking force is controlled by the program, and the angular velocity of the shaft and the cable length pulled out by the user can be determined from the optical sensor signal.

While the invention has been described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

We claim:

1. A rowing exercise machine comprising:

user interface means adapted to accept user stroke movements, each stroke having a power portion and a return portion;

converting means for converting energy imparted to the user interface means during the power portion of a stroke into rotational displacement of a mass about its axis;

opposition force means for providing a force to oppose the rotational displacement of the mass means for determining the beginning of the power portion of the stroke; and control means coupled to said opposition force means and responsive to the determining means for controlling the magnitude of said opposition force.

2. The rowing exercise machine of claim 1 where said opposition force means includes a brake adapted to retard the rotational displacement of the mass.

3. The rowing exercise machine of claim 1 wherein said control means controls the opposition force means to apply a constant force.

4. The rowing exercise machine of claim 1 wherein said control means controls said opposition force means to apply a force according to a predetermined program.

5. The rowing exercise machine of claim 1 further including a user select means coupled to said control means for providing user selectability of the magnitude of said opposition force.

6. The rowing exercise machine of claim 1 wherein said user interface means includes:

a user-engageable cable means capable of being displaced through the stroke movements by a user; and wherein said converting means includes:

a shaft;

a cable drum carried on the shaft and adapted to have the cable means wound thereon and unwound therefrom as the user moves the cable through a stroke;

a flywheel connected to the shaft for receiving and conserving angular momentum imparted to the shaft by displacement of the cable from the cable drum; and wherein said opposition force means includes constant torque brake means connected to the shaft for resisting the angular rotation of the shaft means with a constant torque resistance.

7. The rowing exercise machine of claim 6 further including:

cable retraction means connected to said cable drum means for rewinding the cable onto the cable drum after the user has displaced cable from the drum.

8. The rowing exercise machine of claim 7 wherein said cable retraction means includes:

one-way clutch means interposed between said cable drum and said shaft; and drum rewind means connected to said cable drum for selectively rotating the drum in a direction opposite to the direction of rotation of the shaft, so as to rewind the cable on the drum independently of the motion of the shaft.

9. A rowing exercise machine comprising:

user interface means adapted to accept user stroke movements having a power portion and a return portion;

means for converting the energy imparted to the user interface means during the power portion of the stroke into rotational displacement of a mass about its axis;

opposition force means coupled to said converting means for providing a force to oppose the rotational displacement of the mass;

stroke detecting means responsive to said user interface means for determining the beginning of the power portion of the stroke to provide a signal representative thereof;

velocity sensing means responsive to said converting means for determining the angular velocity of the mass to provide a signal representative thereof; and control means coupled to said opposition force means and responsive to said stroke detecting signal and said velocity signal for controlling said opposition force means to oppose the rotational displacement of the mass with a first force during the power portion of a stroke and a second force during at least part of the return portion of a stroke.

10. The rowing exercise machine of claim 9 wherein said opposition force providing means includes a brake adapted to retard the rotational displacement of the mass.

11. The rowing exercise machine of claim 9 wherein said second force is greater than said first force.

12. The rowing exercise machine of claim 11 wherein said first and second forces are constant forces.

13. The rowing exercise machine of claim 9 further including user select means coupled to said control means for providing user selectability of the magnitude of said first force.

14. The rowing exercise machine of claim 9 further including user select means coupled to said control means for providing user selectability of the magnitude of said second force.

15. The rowing exercise machine of claim 9 wherein said user interface means includes:

a user-engageable cable means capable of being displaced through a stroke by a user; and wherein the exercise machine further includes:

a shaft;

a cable drum carried on the shaft and adapted to have the cable means wound thereon and unwound therefrom as the user moves the cable through a stroke;

a flywheel connected to the shaft for receiving and conserving angular momentum imparted to the shaft by displacement of the cable from the cable drum; and brake means connected to the shaft for resisting the angular rotation of the shaft means with a constant torque resistance.

16. The rowing exercise machine of claim 15 further including:

cable retraction means for rewinding the cable onto the cable drum after the user has displaced cable from the drum.

17. The rowing exercise machine of claim 16 wherein said cable retraction means includes:

one-way clutch means interposed between said cable drum and said shaft; and drum rewind means connected to said cable drum for selectively rotating the drum in a direction opposite to the direction of rotation of the shaft, so as to rewind the cable on the drum independently of the motion of the shaft.

18. An improved rowing exercise machine including:

a user-engageable means capable of being displaced through stroke movements by a user;

a shaft connected to the user-engageable means;

a flywheel connected to the shaft for receiving and conserving angular momentum imparted to the shaft by the user engageable means;

constant torque brake means connected to the shaft for resisting the angular rotation of the shaft means with a constant torque resistance independent of the speed of the user's stroke movements;

and beginning of stroke signalling means driven by said shaft for indicating the beginning of a portion of said stroke.

19. The rowing exercise machine of claim 18 further including clutch means interposed between the user-engageable means and the flywheel for disengaging the user-engageable means from the flywheel during a return portion of the stroke and for engaging the user-engageable means to the flywheel during power portions of the stroke.

20. A rowing exercise machine of claim 18 wherein said beginning-of-stroke signalling means includes:

gear support means;

gear means driven by said shaft and adapted to travel over the gear support means along an axial path with helical motion;

and signal means for changing a signal when the gear has traveled a predetermined axial distance along its path of motion.

21. The rowing exercise machine of claim 18 further including retraction means for resetting the user-engageable means to a beginning-of-stroke position after the machine user has displaced the user-engageable means.

22. A rowing exercise machine comprising:

user interface means adapted to accept user stroke movements;

means for converting energy imparted to the user interface means into rotational displacement of a mass about its axis;

means for providing a controllable brake force to oppose the rotational displacement of the mass about its axis; and electrical control means for controlling said brake force means to provide a brake force the magnitude of which is independent of the physical characteristics of the brake force means.

23. The rowing exercise machine of claim 22 wherein each user stroke movement has a power portion and a return portion and further including means for sensing the beginning of a power portion of a stroke and means for sensing the completion of the power portion of the stroke, said control means being responsive to the beginning of power stroke sensing means for controlling the brake force means to provide a first brake force during at least a part of the power portion of the stroke and being responsive to the completion of power stroke sensing means for controlling the brake force means to provide a second brake force during at least a part of the return portion of the stroke.

24. The rowing exercise machine of claim 23 wherein said control means controls the brake force means to provide a second brake force which is greater than the first brake force.

25. The rowing exercise machine of claim 22 wherein each stroke movement has a power portion and the control means controls the brake force means to provide a constant force during the power portion of the stroke.

26. A rowing exercise machine comprising:

user interface means adapted to accept user stroke movements;

means coupled to said user interface means for converting user stroke movements into simulated boat movement;

means responsive to said boat simulating means for sensing the speed of simulated boat movement to provide a signal representative thereof;

means for displaying a rowing scene with animated characters representing the user and a pace boat being depicted with respect to a background;

means responsive to said speed sensing means for controlling the display means to scroll the background with respect to said animated characters at a scroll rate determined in response to the sensed speed and to vary the relative horizontal positions of the user and pace boat characters in accordance with variations of the sensed speed as compared to a reference speed.

27. The rowing exercising machine of claim 26 wherein the distance separating the user and pace boat characters on the display represents the actual distance which would separate the user moving at the sensed speed from a pace boat moving at said reference speed.

28. The rowing exercise machine of claim 26 wherein said background includes a near background and a far background and said display control means scrolls the far background at a rate which is less than the scroll rate of the near background.

29. The rowing machine of claim 26 further including means for detecting the beginning of a user's stroke movement, said display control means being responsive to said beginning of stroke detecting means to control the animation of the user character to stroke in synchronism with the user's stroke movements.

30. The rowing exercise machine of claim 29 wherein said display control means controls the animation of the pace boat character to stroke at a constant rate independent of the motion of the user character.

31. The rowing exercise machine of claim 26 further including input means operable by a user to select one of a plurality of difficulty levels each having an associated reference speed, said control means being responsive to the selected difficulty level to vary the relative horizontal positions of the characters in accordance with the variations of the sensed speed as compared to the reference speed associated with the selected level.

32. A rowing exercise machine comprising:

user interface means adapted to accept user stroke movements;

means coupled to said user interface means for converting user stroke movements into simulated boat movement;

means responsive to said converting means for detecting the beginning of a stroke;

means for displaying a rowing scene with an animated character representing the user;

means responsive to said beginning of stroke detecting means for controlling said display means to control the animation of the user character to stroke in synchronism with the user's stroke movements.

33. The rowing exercise machine of claim 32 wherein said display means displays a rowing scene with an animated character representing a pace boat and said display control means controls the animation of the pace boat character to stroke at a constant rate independent of the motion of the user character.

34. The rowing exercise machine of claim 33 further including input means operable by a user to select one of a plurality of difficulty levels each having an associated constant stroke rate, said display control means being responsive to the difficulty level selected by a user to control the animation of the pace boat character to stroke at the constant stroke rate associated with the selected level.

* * * * *

UNITED STATES PATENT AND TRADEMARK OFFICE

CERTIFICATE OF CORRECTION

PATENT NO. : 4,674,741

DATED : June 23, 1987

INVENTOR(S) : John J. Pasierb, Jr. et al.

It is certified that error appears in the above-identified patent and that said Letters Patent is hereby corrected as shown below:

Column 5, line 42, after "116" insert -- of the gear 112 --

Column 8, line 33, change "150 mA" to -- 150mA --

Column 9, line 44, delete "∓PACER"" and insert -- "PACER" --

Signed and Sealed this

Twelfth Day of January, 1988

*Attest:*

DONALD J. QUIGG

*Attesting Officer*

*Commissioner of Patents and Trademarks*